US009067442B2

(12) United States Patent
Tanaka

(10) Patent No.: US 9,067,442 B2
(45) Date of Patent: Jun. 30, 2015

(54) MEDIUM CARTRIDGE AND MEDIUM PRINTER WITH A CARTRIDGE

(71) Applicant: Brother Kogyo Kabushiki Kaisha, Nagoya-shi, Aichi-ken (JP)

(72) Inventor: Mitsugi Tanaka, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/501,168

(22) Filed: Sep. 30, 2014

(65) Prior Publication Data

US 2015/0116442 A1 Apr. 30, 2015

(30) Foreign Application Priority Data

Oct. 31, 2013 (JP) ..... 2013-226610

(51) Int. Cl.
*B41J 11/00* (2006.01)
*B41J 11/22* (2006.01)

(52) U.S. Cl.
CPC ..... *B41J 11/22* (2013.01)

(58) Field of Classification Search
USPC ..... 347/211, 213–215, 217–219, 222, 171, 347/175, 176; 400/611, 618, 621, 120.03, 400/120.04
See application file for complete search history.

(56) References Cited

U.S. PATENT DOCUMENTS

| | | | | |
|---|---|---|---|---|
| 5,959,652 | A * | 9/1999 | Privin | 347/214 |
| 6,132,119 | A | 10/2000 | Nakajima et al. | |
| 6,621,510 | B2 * | 9/2003 | Hayashi | 347/214 |
| 7,213,990 | B2 * | 5/2007 | Yamamoto | 347/214 |
| 2006/0092193 | A1 | 5/2006 | Block et al. | |

FOREIGN PATENT DOCUMENTS

JP 2005-186583 A 7/2005

OTHER PUBLICATIONS

Mar. 10, 2015—(EP) Extended European Search Report—App 14187009.7.

* cited by examiner

*Primary Examiner* — Kristal Feggins
(74) *Attorney, Agent, or Firm* — Banner & Witcoff, Ltd.

(57) ABSTRACT

This disclosure discloses a medium cartridge that comprises a first record medium roll that winds a record medium in a manner that enables feed-out. The medium cartridge is configured to be mounted to a printer. In the printer, a print mechanism configured to perform print on the record medium is provided movably along a medium-width direction of the record medium with respect to an opening/closing cover capable of opening and closing at least an area above a part of an apparatus housing. The medium cartridge comprises a positioning contacting part. The positioning contacting part is configured to separate from a contacted part provided on the print mechanism with the opening/closing cover open. Further, the positioning contacting part is configured to contact the contacted part of the print mechanism and position the print mechanism in the medium-width direction with the opening/closing cover closed.

8 Claims, 10 Drawing Sheets

MEDIUM CARTRIDGE AND MEDIUM PRINTER WITH A CARTRIDGE

CROSS-REFERENCE TO RELATED APPLICATION

The present application claims priority from Japanese Patent Application No. 2013-226610, which was filed on Oct. 31, 2013, the disclosure of which is incorporated herein by reference in its entirety.

BACKGROUND

1. Field

The present disclosure relates to a medium cartridge mounted to and used in a printer comprising a print mechanism.

2. Description of the Related Art

There have been known printers comprising a print mechanism that performs printing on a tape. According to this prior art, a technique is disclosed for correcting any deviation or the like of the print formed on the tape caused by misalignment between a reference position of the tape fed inside the apparatus in a tape-width direction and a reference position for print by the print mechanism, using print control.

In the above described prior art, when the misalignment occurs, the user enters the amount of misalignment into the apparatus side as a correction value. With this arrangement, print control is thereafter performed on the print mechanism so as to correct the reference position for print by the print mechanism and resolve the misalignment. Accordingly, the correction value needs to be entered each time misalignment occurs, making the operation labor of the user cumbersome and necessitating the complex correction value-based print control.

SUMMARY

It is therefore an object of the present disclosure to provide a medium cartridge and a medium printer with a cartridge capable of suppressing the occurrence of deviation of print formed on a tape and the like, without performing complex print control or other such processes.

In order to achieve the above-described object, according to the aspect of the present application, there is provided a medium cartridge that comprises a first record medium roll that winds a record medium in a manner that enables feed-out, and is configured to be mounted to a printer wherein a print mechanism configured to perform print on the record medium is provided movably along a medium-width direction of the record medium with respect to an opening/closing cover capable of opening and closing at least an area above a part of an apparatus housing, the medium cartridge comprising a positioning contacting part configured to separate from a contacted part provided on the print mechanism with the opening/closing cover open, and to contact the contacted part of the print mechanism and position the print mechanism in the medium-width direction with the opening/closing cover closed.

The medium cartridge of the present disclosure is mounted to and used in a printer comprising a print mechanism. That is, when the medium cartridge is mounted, desired print is formed by the print mechanism on the record medium fed out from a first record medium roll. At this time, according to the present disclosure, at least a portion of the apparatus housing of the printer is configured to be openable and closeable by an opening/closing cover, and the print mechanism is provided on the opening/closing cover, executing the print operation with the opening/closing cover closed.

Hence, in a case of a configuration wherein the print mechanism is provided on the opening/closing cover as described above, the relative positions between the reference position of the record medium fed out on the apparatus housing side in the medium-width direction (width-direction center, for example) and the reference position for print (the center position of the print range, for example) by the print mechanism may become misaligned in the medium-width direction (from the positional relationship originally set) due to play or the like that exists in each apparatus component for the opening/closing operation of the opening/closing cover. In such a case, a decrease in print quality, such as deviation of the print formed on the record medium to one side of the medium-width direction, may occur.

Hence, in the present disclosure, the print mechanism is provided movably in the medium-width direction with respect to the opening/closing cover, and a positioning contacting part that positions the moveable print mechanism is provided on the medium cartridge side. A corresponding contacted part is then provided on the print mechanism.

Then, the positioning contacting part is separated from the contacted part of the print mechanism when the opening/closing cover is open, and contacts the contacted part when the opening/closing cover is closed. With this arrangement, the print mechanism moveable in the medium-width direction is positioned in the medium-width direction. As a result, it is possible to suppress the occurrence of the aforementioned deviation of the print formed on the record medium and the like and improve print quality, without performing complex print control or other such processes.

DETAILED DESCRIPTION OF THE PREFERRED EMBODIMENTS

Figure 1:
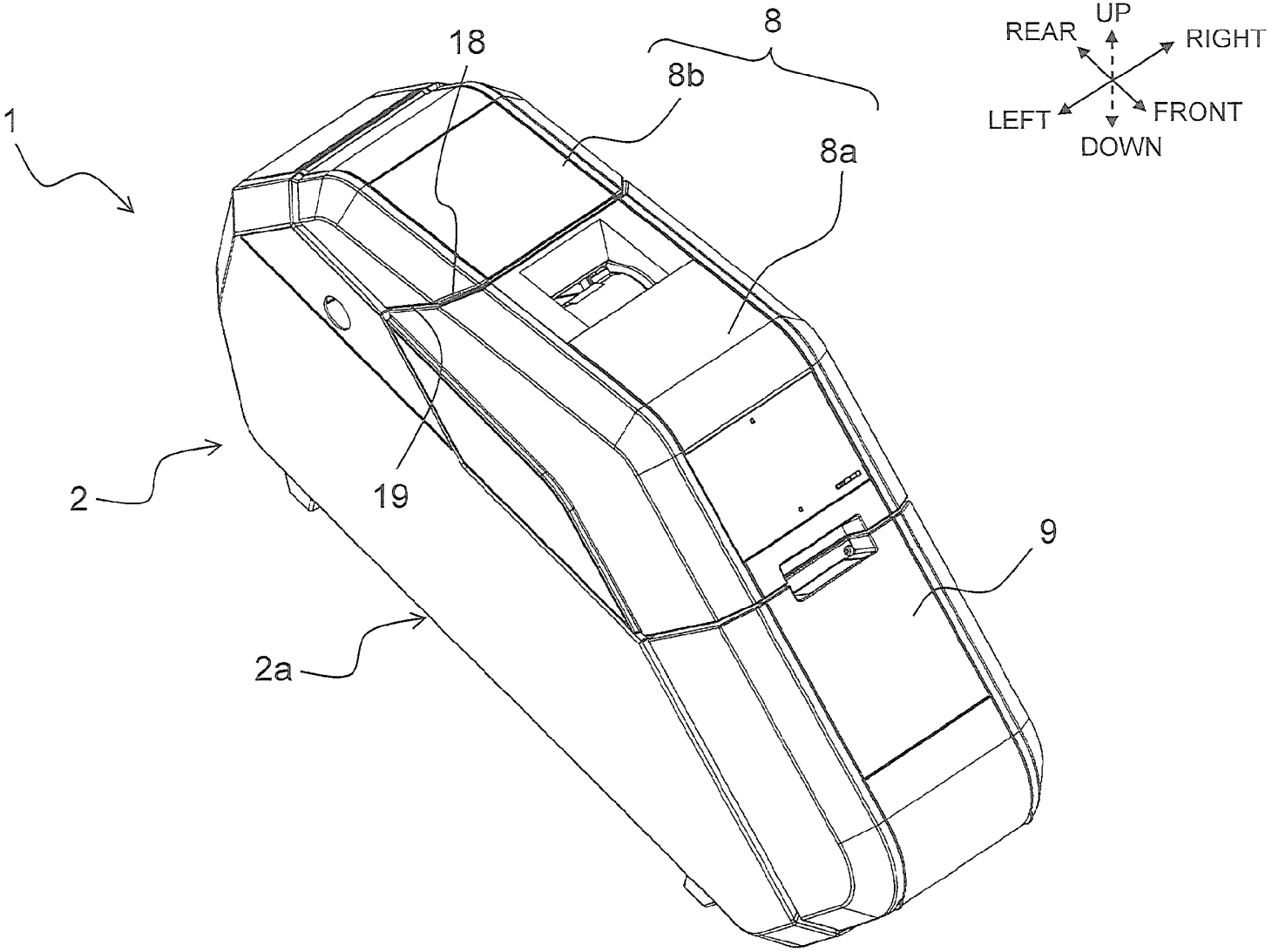
FIG. 1 is a perspective view showing the outer appearance of the tape printer related to an embodiment of the present disclosure.

The following describes one embodiment of the present disclosure with reference to accompanying drawings. Note that, in a case where "Front," "Rear," "Left," "Right," "Up," and "Down" are denoted in the drawings, the terms "Frontward (Front)," "Rearward (Rear)," "Leftward (Left)," "Rightward (Right)," "Upward (Up)," and "Downward (Down)" in the explanations of the description refer to the denoted directions.

General Configuration of Tape Printer

First, the general configuration of the tape printer related to this embodiment will be described with reference to FIGS. 1-4.

Housing

In FIGS. 1-4, a tape printer 1 in this embodiment comprises a housing 2 that constitutes the apparatus outer contour. The housing 2 comprises a housing main body 2*a*, a rearward-side opening/closing part 8, and a frontward-side opening/closing cover 9.

The housing main body 2*a* comprises a first storage part 3 disposed on the rearward side, and a second storage part 5 and a third storage part 4 disposed on the frontward side.

The rearward-side opening/closing part 8 is connected to the upper area of the rearward side of the housing main body 2*a* in an openable and closeable manner. This rearward-side opening/closing part 8 is capable of opening and closing the area above the first storage part 3 by pivoting. The rearward-side opening/closing part 8 comprises a first opening/closing cover 8*a* and a second opening/closing cover 8*b*.

The first opening/closing cover 8*a* is capable of opening and closing the area above the frontward side of the first storage part 3 by pivoting around a predetermined pivot axis K1 disposed in the upper area of the rearward side of the housing main body 2*a*. Specifically, the first opening/closing cover 8*a* is capable of pivoting from a closed position (the states of FIGS. 1 and 2) in which it covers the area above the frontward side of the first storage part 3, to an open position (the states of FIGS. 3 and 4) in which it exposes the area above the frontward side of the first storage part 3.

Figure 2:
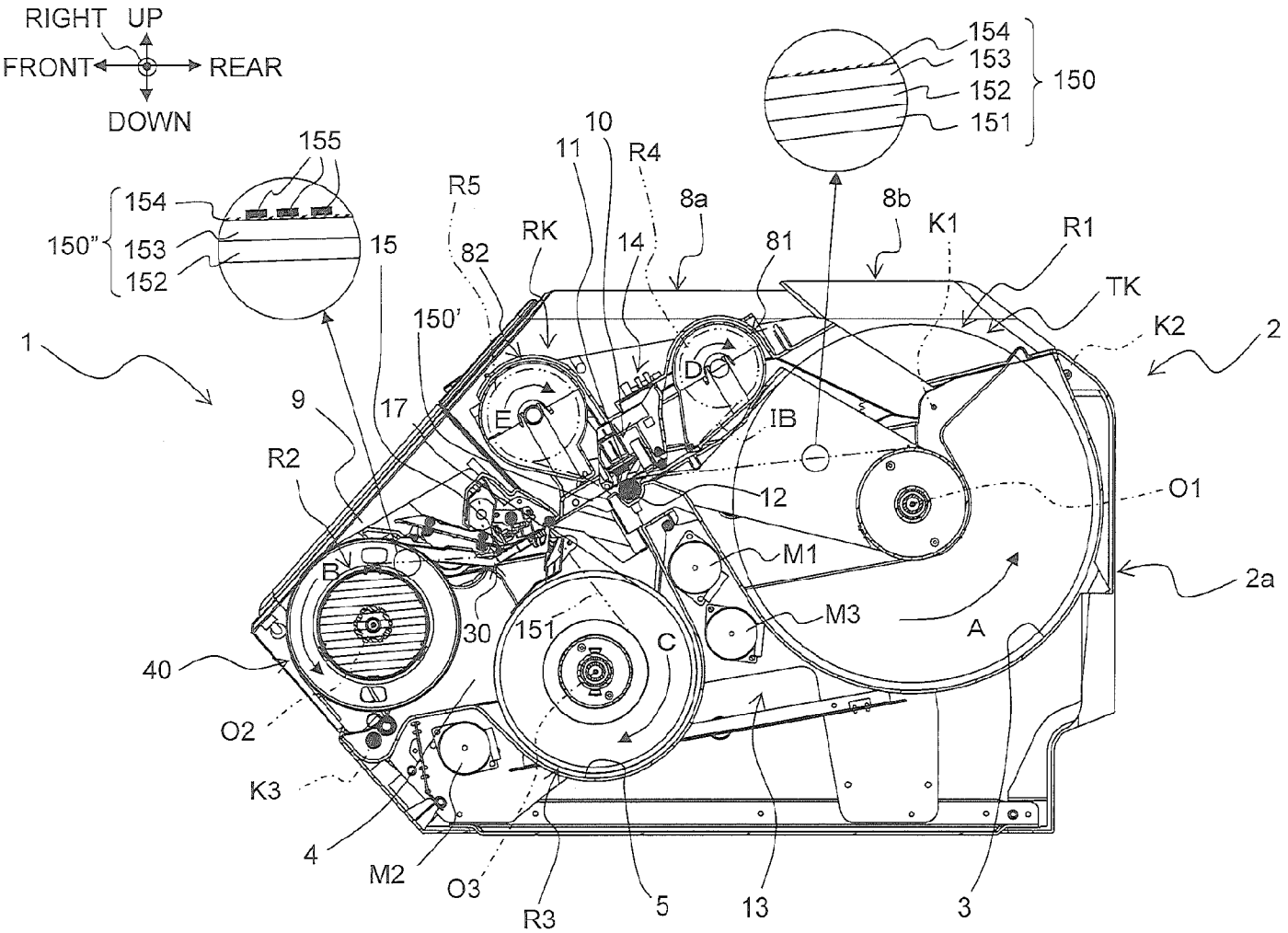
FIG. 2 is a side cross-sectional view showing the internal structure of the tape printer.
Figure 3:
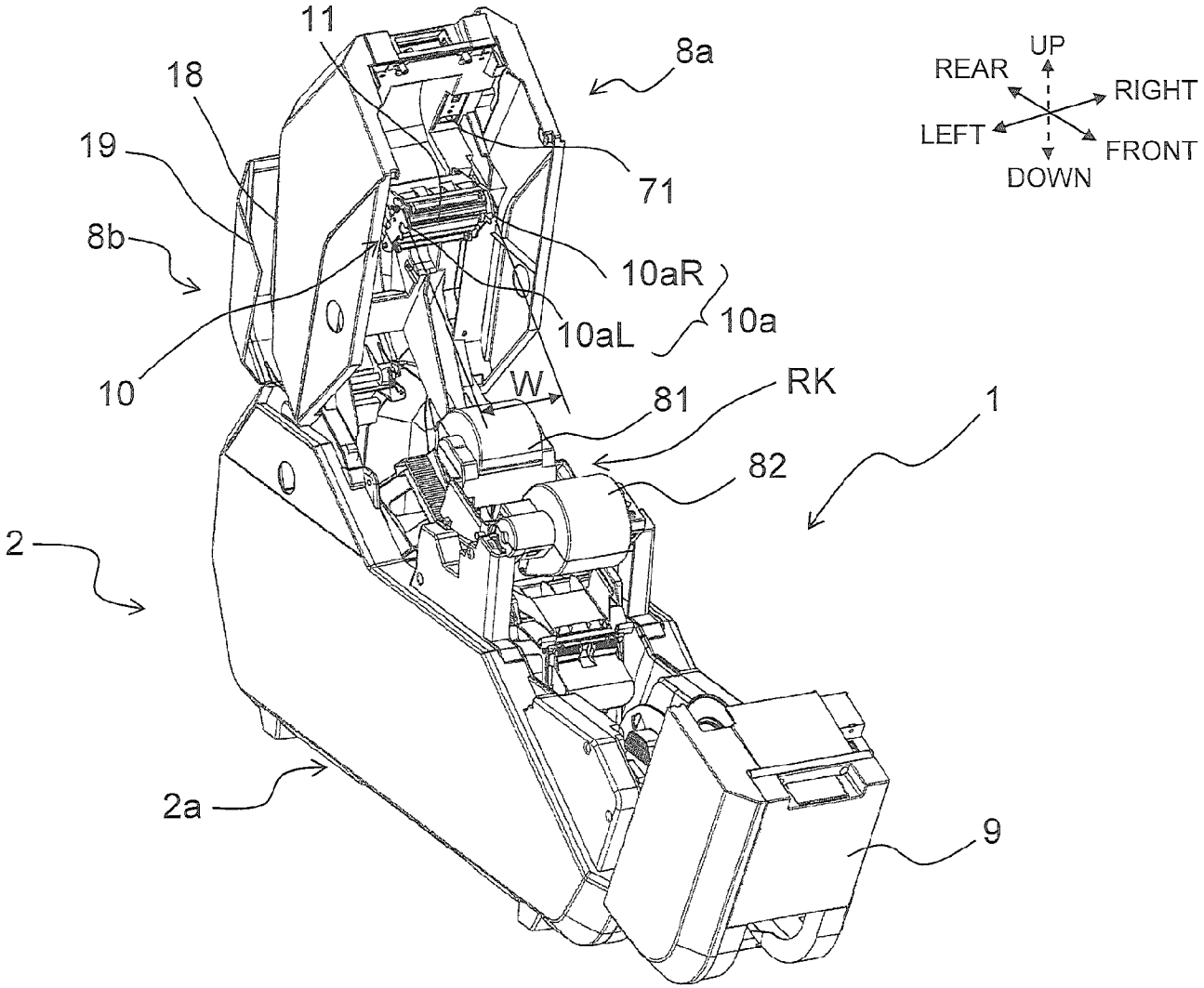
FIG. 3 is a perspective view showing the outer appearance of the tape printer with the first, second, and frontward-side opening/closing covers open.

A head holding body 10 is disposed in the interior of the first opening/closing cover 8*a* (refer to FIG. 3 as well). Then, the first opening/closing cover 8*a* pivots around the above described pivot axis K1, making it possible to move a print head 11 disposed on the head holding body 10 relatively closer to or farther away from a feeding roller 12 disposed on the housing main body 2*a*. Specifically, the first opening/closing cover 8*a* is capable of pivoting from a closed position (the states of FIGS. 1 and 2) in which the print head 11 is close to the feeding roller 12, to an open position (the states of FIGS. 3 and 4) in which the print head 11 is far away from the feeding roller 12.

The second opening/closing cover 8*b* is disposed further on the rearward side than the above described first opening/closing cover 8*a*, and is capable of opening and closing the area above the rearward side of the first storage part 3 separately from the opening and closing of the above described first opening/closing cover 8*a* by pivoting around a predetermined pivot axis K2 disposed on the upper end of the rearward side of the housing main body 2*a*. Specifically, the second opening/closing cover 8*b* is capable of pivoting from a closed position (the states of FIGS. 1 and 2) in which it covers the area above the rearward side of the first storage part 3, to an open position (the states of FIGS. 3 and 4) in which it exposes the area above the rearward side of the first storage part 3.

Then, the first opening/closing cover 8*a* and the second opening/closing cover 8*b* are configured so that, when each is closed, an outer peripheral part 18 of the first opening/closing cover 8*a* and an edge part 19 of the second opening/closing cover 8*b* substantially contact each other and cover almost the entire area above the first storage part 3.

The frontward-side opening/closing cover 9 is connected to the upper area of the frontward side of the housing main body 2*a* in an openable and closeable manner. The frontward-side opening/closing cover 9 is capable of opening and closing the area above the third storage part 4 by pivoting around the predetermined pivot axis K3 disposed on the upper end of the frontward side of the housing main body 2*a*. Specifically, the frontward-side opening/closing cover 9 is capable of pivoting from a closed position (the states of FIGS. 1 and 2) in which it covers the area above the third storage part 4, to an open position (the states of FIGS. 3 and 4) in which it exposes the area above the third storage part 4.

Print-Receiving Tape Roll and Surrounding Area Thereof

Figure 4:
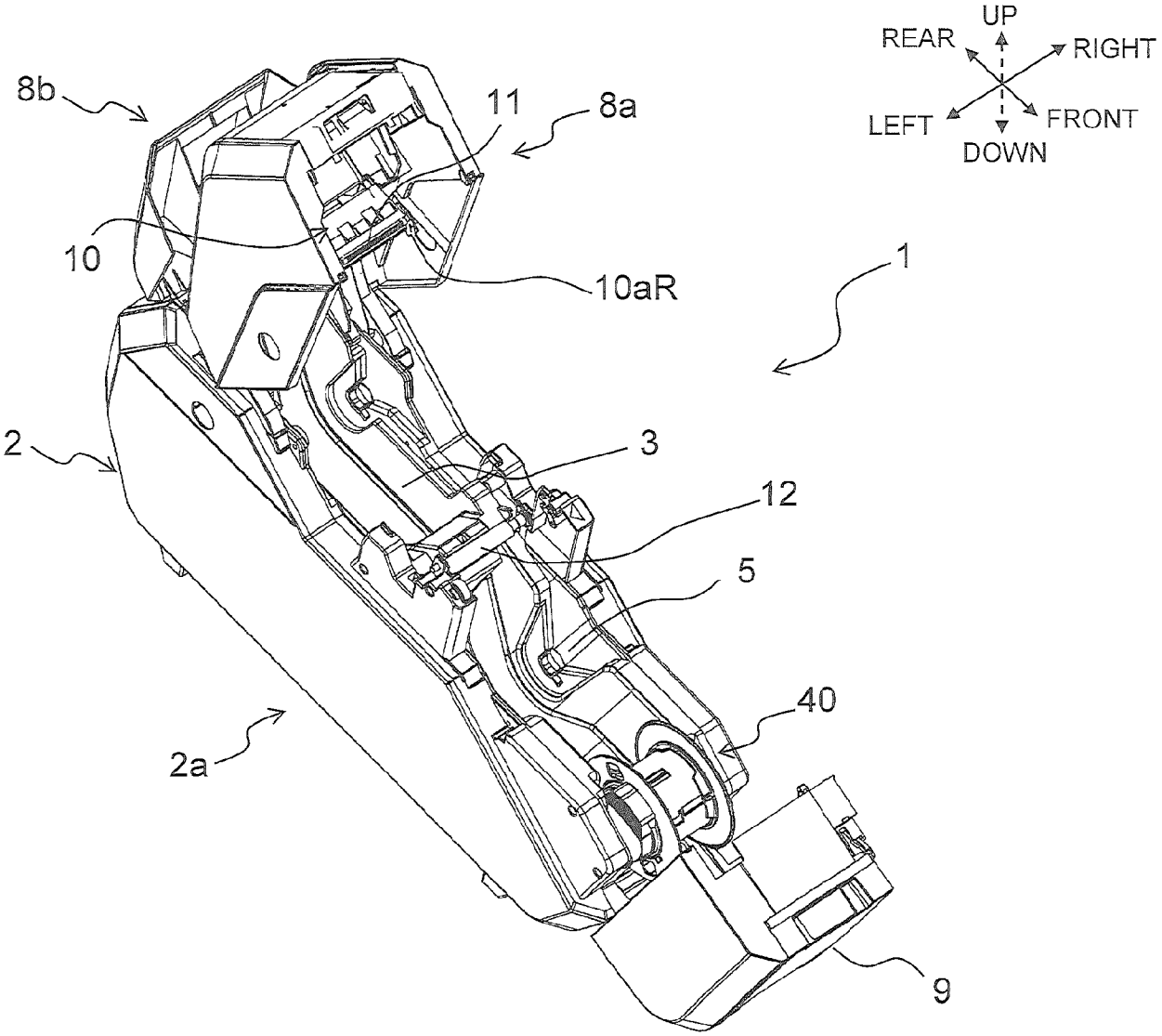
FIG. 4 is a perspective view showing the tape printer with the first, second, and frontward-side opening/closing covers open and the tape cartridge and ink ribbon cartridge removed.

At this time, as shown in FIGS. 2-4, a tape cartridge TK (refer to FIG. 2) is detachably mounted in a first predetermined position 13 below the frontward-side opening/closing cover 9 (when closed) in the housing main body 2*a*. This tape cartridge TK comprises a print-receiving tape roll R1 wound around and formed on an axis O1.

Figure 5:
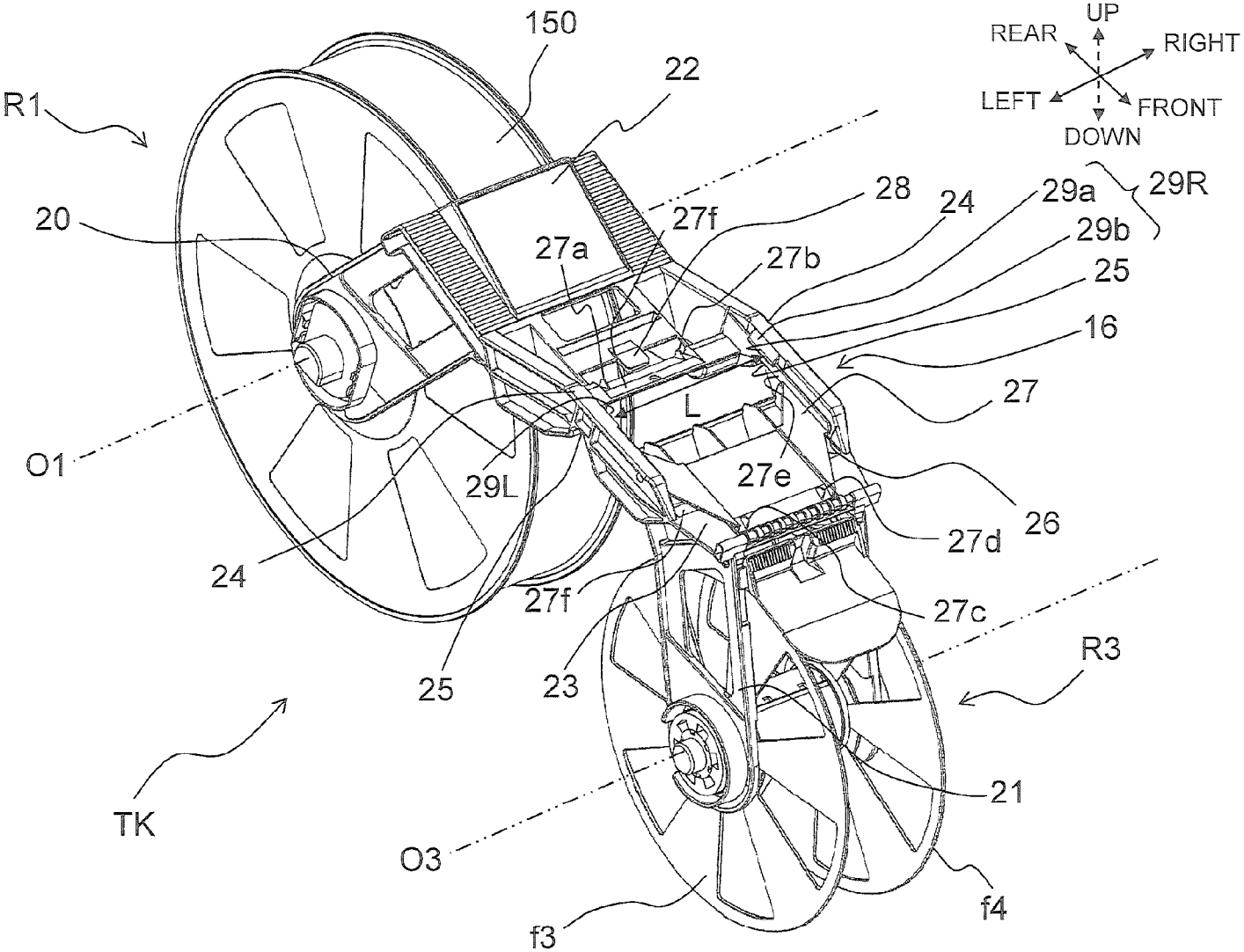
FIG. 5 is a perspective view showing the overall configuration of the tape cartridge from above.

That is, the tape cartridge TK comprises the print-receiving tape roll R1 and a connecting arm 16, as shown in FIG. 5. The connecting arm 16 comprises a left and right pair of first bracket parts 20, 20 disposed on the rearward side, and a left and right pair of second bracket parts 21, 21 disposed on the frontward side.

The first bracket parts 20, 20 are set so that the above described print-receiving tape roll R1 is sandwiched by both the left and right sides along the axis O1, holding the print-receiving tape roll R1 rotatably around the axis O1 with the tape cartridge TK mounted to the housing main body 2*a* (the detailed holding structure will be described later). These first bracket parts 20, 20 are connected by a first connecting part 22 that extends substantially along the left-right direction on the upper end, avoiding interference with the outer diameter of the print-receiving tape roll R1.

The print-receiving tape roll R1 is rotatable when the tape cartridge TK is mounted in the interior of the housing main body 2*a*. The print-receiving tape roll R1 winds a print-receiving tape 150 (comprising a print-receiving layer 154, a base layer 153, an adhesive layer 152, and a separation material layer 151 described later; refer to the enlarged view in FIG. 2) consumed by feed-out around the axis O1 in the left-right direction in advance.

The print-receiving tape roll R1 is received in the first storage part 3 from above by the mounting of the above described tape cartridge TK and stored with the axis O1 of the winding of the print-receiving tape 150 in the left-right direction. Then, the print-receiving tape roll R1, stored in the first storage part 3 (with the tape cartridge TK mounted), rotates in a predetermined rotating direction (a direction A in FIG. 2) inside the first storage part 3, thereby feeding out the print-receiving tape 150.

This embodiment illustrates a case where a print-receiving tape 150 comprising adhesive is used. That is, the print-receiving tape 150 is layered in the order of the print-receiving layer 154, the base layer 153, the adhesive layer 152, and the separation material layer 151, from one side in the thickness direction (upward side in FIG. 2) to the other side (downward side in FIG. 2). The print-receiving layer 154 is a layer in which a desired print part 155 (refer to the enlarged partial view in FIG. 2) is formed by the heat transfer of ink from the above described print head 11. The adhesive layer 152 is a layer for affixing the base layer 153 to a suitable adherent (not shown). The separation material layer 151 is a layer that covers the adhesive layer 152.

Feeding Roller and Print Head

Returning to FIGS. 2-4, the above described feeding roller 12 is disposed on a middle upward side of the first storage part 3 and the second storage part 5 of the housing main body 2*a*.

The feeding roller 12 is driven by a feeding motor M1 disposed in the interior of the housing main body 2*a* via a gear mechanism (not shown), thereby feeding the print-receiving tape 150 fed out from the print-receiving tape roll R1 stored in the first storage part 3 in a tape posture in which the tape-width direction is in the left-right direction.

Further, the above described head holding part 10 disposed on the first opening/closing cover 8*a* comprises the above described print head 11. The print head 11, as described above, is capable of moving relatively closer to or farther away from the feeding roller 12 by the pivoting of the first opening/closing cover 8*a* around the pivot axis K1. That is, the print head 11 moves closer to the feeding roller 12 when the first opening/closing cover 8*a* is closed, and farther away from the feeding roller 12 when the first opening/closing cover 8*a* is opened. This print head 11 is disposed in a position that faces the area above the feeding roller 12 of the head holding part 10, with the first opening/closing cover 8*a* closed, sandwiching the print-receiving tape 150 fed by the feeding roller 12 in coordination with the feeding roller 12. Accordingly, when the first opening/closing cover 8*a* is closed, the print head 11 and the feeding roller 12 are disposed facing each other in the up-down direction. Then, the print head 11 forms desired print on the print-receiving layer 154 of the print-receiving tape 150 sandwiched between the print head 11 and the feeding roller 12 using an ink ribbon IB of an ink ribbon cartridge RK described later, thereby forming a tape 150' with print.

Ink Ribbon Cartridge

Figure 6:
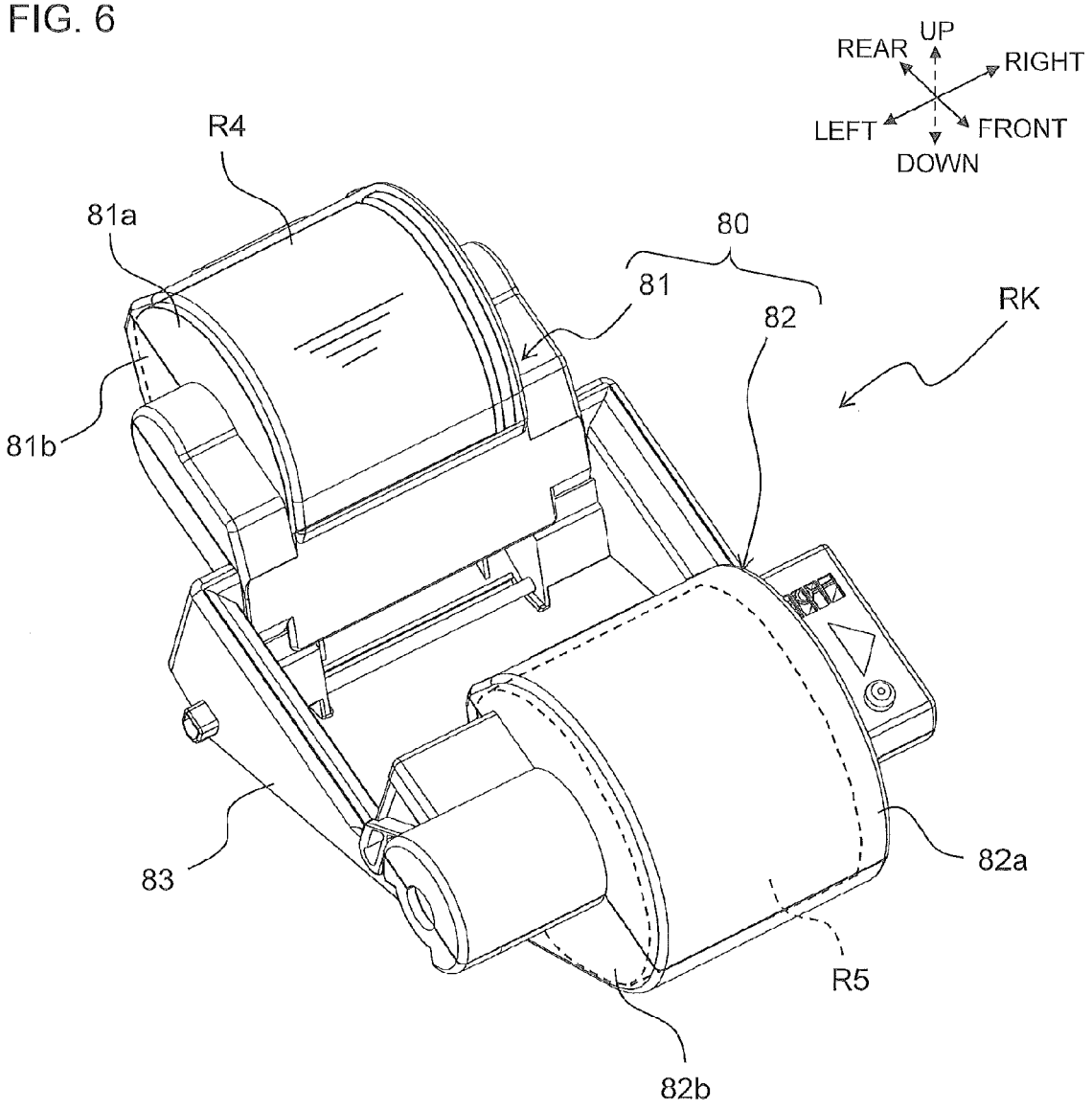
FIG. 6 is a perspective view showing the overall configuration of the ink ribbon cartridge.

As shown in FIG. 2 and FIG. 3, the ink ribbon cartridge RK is detachably mounted in a second predetermined position 14, which is below the first opening/closing cover 8*a* (when closed) and above the tape cartridge TK in the housing main body 2*a*. FIG. 6 shows the detailed structure of the ink ribbon cartridge RK.

As shown in FIG. 6, the ink ribbon cartridge RK comprises a cartridge housing 80, a ribbon feed-out roll R4 around which is wound an unused ink ribbon IB in manner that enables feed-out, and a ribbon take-up roll R5. The cartridge housing 80 comprises a rearward-side feed-out roll storage part 81, a frontward-side take-up roll storage part 82, and a coupling part 83 that couples both of these storage parts 81, 82. The coupling part 83 couples the above described take-up roll storage part 82 and the above described feed-out roll storage part 81 while exposing the above described ink ribbon IB fed out from the ribbon feed-out roll R4 to the outside of the cartridge housing 80.

The feed-out roll storage part 81 is configured by combining a substantially semi-cylindrical upper part 81*a* (section on one side) and a lower part 81*b*. The ribbon feed-out roll R4 is rotatably supported inside the feed-out roll storage part 81, and rotates in a predetermined rotating direction (a direction D in FIG. 2) with the ink ribbon cartridge RK mounted, thereby feeding out the ink ribbon IB for performing print by the print head 11.

The take-up roll storage part 82 is configured by combining a substantially semi-cylindrical upper part 82*a* and a lower part 82*b*. The ribbon take-up roll R5 is rotatably supported inside the take-up roll storage part 82 and rotates in a predetermined rotating direction (a direction E in FIG. 2) with the ink ribbon cartridge RK mounted, thereby taking up the used ink ribbon IB after print.

That is, in FIG. 2, the ink ribbon IB fed out from the ribbon feed-out roll R4 is disposed further on the print head 11 side of the print-receiving tape 150 sandwiched between the print head 11 and the feeding roller 12, contacting the area below the print head 11. Then, after the ink of the ink ribbon IB is transferred to the print-receiving layer 154 of the print-receiving tape 150 by the heat from the print head 11 to execute print, the used ink ribbon IB is taken up on the ribbon take-up roll R5.

Separation Material Roll and Surrounding Area Thereof

As shown in FIG. 5, the connecting arm 16 of the tape cartridge TK comprises a peeling part 17 that includes a substantially horizontal slit shape, for example. This peeling part 17 is an area that peels the separation material layer 151 from a tape 150' with print fed out from the print-receiving tape roll R1 and fed toward the frontward side. As shown in FIG. 2, the above described peeling part 17 peels the above described separation material layer 151 from the tape 150' with print on which print was formed as described above, thereby separating the separation material layer 151 and the tape 150" with print made of the other layers, i.e., the print-receiving layer 154, the base layer 153, and the adhesive layer 152.

The tape cartridge TK, as shown in FIG. 2 and FIG. 5, comprises a separation material roll R3 formed by winding the above described peeled separation material layer 151 around an axis O3. That is, the separation material roll R3 is received in the above described second storage part 5 from above by the mounting of the aforementioned tape cartridge TK and stored with the axis O3 for winding the separation material layer in the left-right direction. Then, the separation material roll R3, stored in the second storage part 5 (with the tape cartridge TK mounted), is driven by a separation sheet take-up motor M3 that is disposed on an interior substrate 2*b* of the housing main body 2*a* via a gear mechanism (not shown) and rotates in a predetermined rotating direction (a direction C in FIG. 2) inside the second storage part 5, thereby taking up the separation material layer 151.

At this time, as shown in FIG. 5, the above described second bracket parts 21, 21 of the tape cartridge TK are set so that the above described separation material roll R3 is sandwiched by both the left and right sides along the axis O3, holding the separation material roll R3 rotatably around the axis O3 with the tape cartridge TK mounted to the housing main body 2*a*. These second bracket parts 21, 21 are connected by a second connecting part 23 extended substantially along the left-right direction on the upper end. Then, the first bracket parts 20, 20 and the first connecting part 22 on the rearward side, and the second bracket parts 21, 21 and the second connecting part 23 on the frontward side are coupled by a left and right pair of roll coupling beam parts 24, 24.

Figure 7:
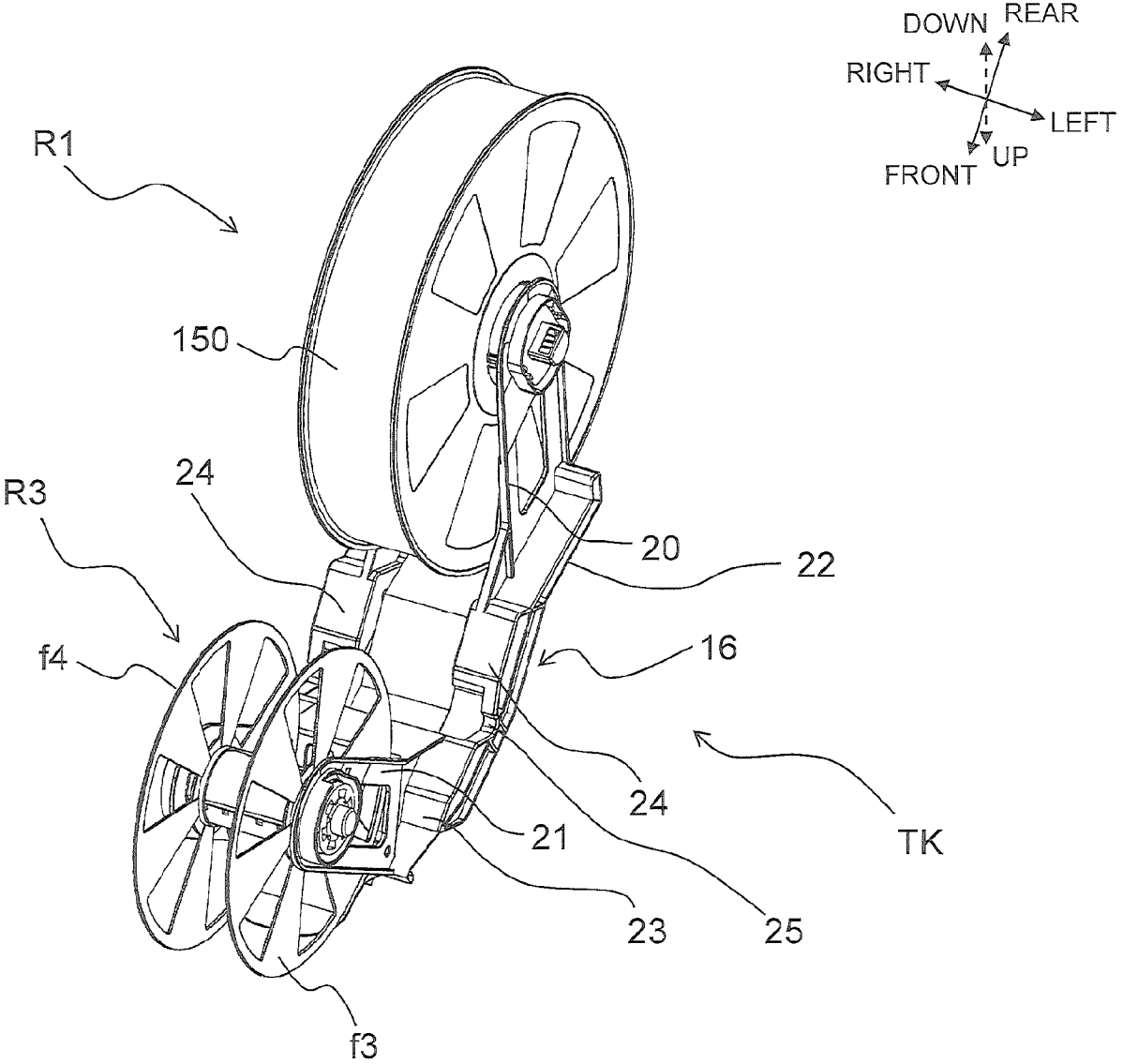
FIG. 7 is a perspective view showing the overall configuration of the tape cartridge from below.
Figure 8:
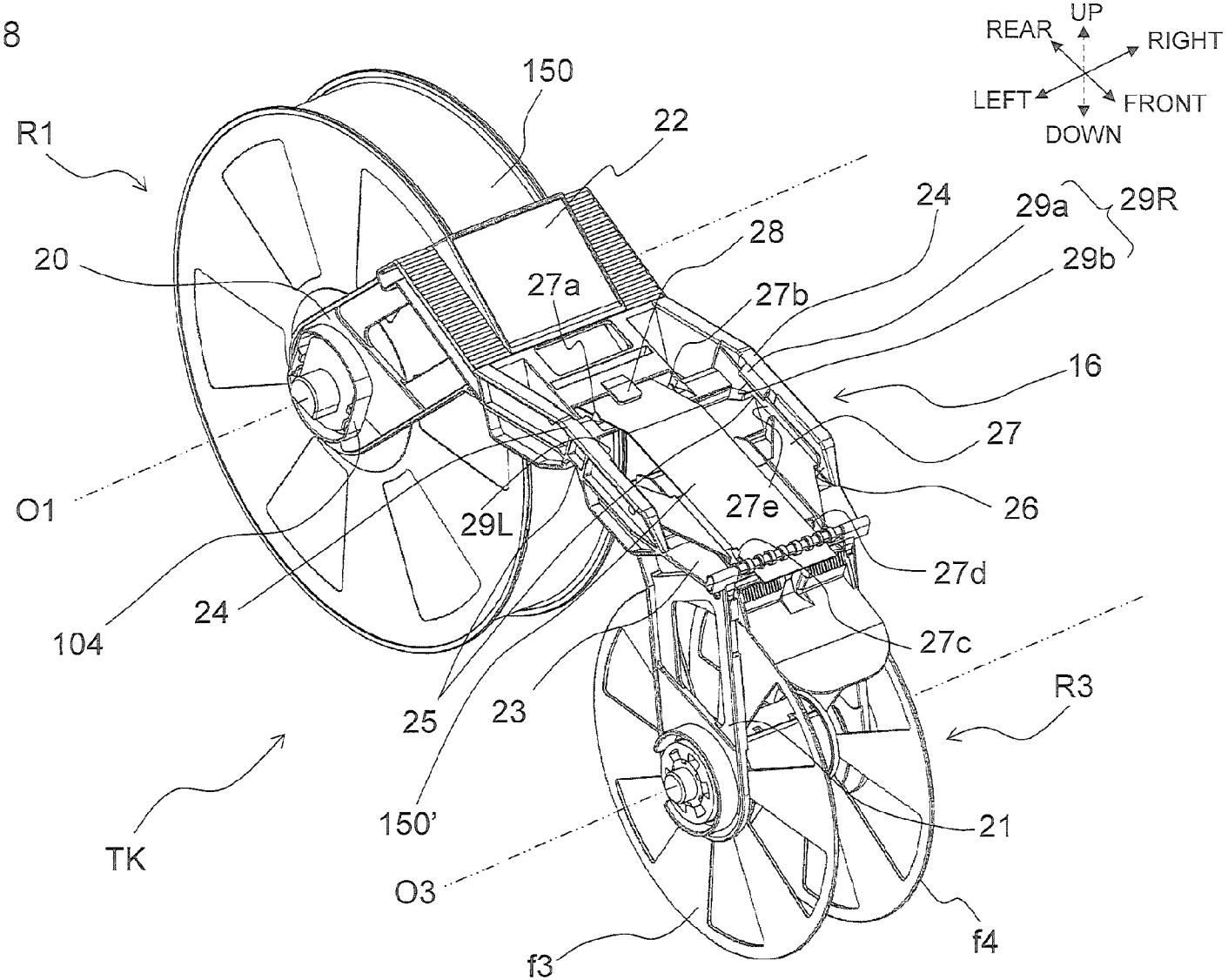
FIG. 8 is a perspective view showing the overall configuration of the tape cartridge during tape feed-out.

Note that substantially semi-arc shaped concave roller storage parts 25, 25, where the upper half of the above described feeding roller 12 is stored with the tape cartridge TK mounted to the housing main body 2*a*, are disposed in the substantial middle of each of the left and right pair of roll coupling beam parts 24, 24, as shown in FIG. 7 and the above described FIG. 5 and FIG. 8.

Further, FIG. 5 shows the state before the separation material layer 151 is wound around the axis O3 and the separation material roll R3 is formed (in the case of the unused tape cartridge TK). That is, FIG. 5 shows a substantially circular roll flange parts f3, f4 disposed so as to sandwich both width-direction sides of the separation material layer 151, and conveniently denotes the location where the separation material roll R3 is formed using the reference number "R3."

Tape Roll with Print and Surrounding Area Thereof

On the other hand, as shown in FIG. 2 and FIG. 4, a take-up mechanism 40 for sequentially winding the above described tape 150" with print is received in the above described third storage part 4 from above. The take-up mechanism 40 is stored so that it is supported rotatably around an axis O2 with the axis O2 of the winding of the tape 150" with print in the left-right direction. Then, the take-up mechanism 40, stored in the third storage part 4, is driven by an adhesive take-up motor M2 that is disposed in the interior of the housing main body 2*a* via a gear mechanism (not shown) and rotates in a predetermined rotating direction (a direction B in FIG. 2) inside the third storage part 4, taking up and layering the tape 150" with print. With this arrangement, the tape 150" with print is sequentially wound around the outer peripheral side of the take-up mechanism 40, forming a tape roll R2 with print.

Cutter Mechanism 30

Further, as shown in FIG. 2, a cutter mechanism 30 is disposed on the downstream side of the print head 11 and the upstream side of the tape roll R2 with print, along the tape transport direction.

The cutter mechanism 30, while not shown in detail, comprises a movable blade and a carriage that supports the movable blade, and is capable of travelling in the tape-width direction (in other words, the left-right direction). Then, the carriage travels by the driving of a cutter motor (not shown) and the movable blade moves in the tape-width direction, cutting the above described tape 150" with print in the width direction.

Overview of the Operation of the Tape Printer

Next, an overview of the operation of the tape printer 1 with the above described configuration will be described.

That is, when the tape cartridge TK is mounted in the above described first predetermined position 13, the print-receiving tape roll R1 is stored in the first storage part 3 positioned on the rearward side of the housing main body 2*a*, and the axis O3 side that forms the separation material roll R3 is stored in the second storage part 5 positioned on the frontward side of the housing main body 2*a*. Further, the take-up mechanism 40 for forming the tape roll R2 with print is stored in the third storage part 4 positioned on the frontward side of the housing main body 2*a*.

At this time, when the feeding roller 12 is driven, the print-receiving tape 150 fed out by the rotation of the print-receiving tape roll R1 stored in the first storage part 3 is fed to the frontward side. Then, desired print is formed by the print head 11 on the print-receiving layer 154 of the print-receiving tape 150 thus fed, thereby forming the tape 150' with print. When the tape 150' with print on which print was formed is further fed to the frontward side and fed to the peeling part 17, the separation material layer 151 is peeled at the peeling part 17, forming the adhesive tape 150" with print. The peeled separation material layer 151 is fed to the downward side, introduced to the second storage part 5, and wound inside the second storage part 5, forming the separation material roll R3.

On the other hand, the adhesive tape 150" with print from which the separation material layer 151 was peeled is further fed to the frontward side, introduced to the third storage part 4, and wound around the outer peripheral side of the take-up mechanism 40 inside the third storage part 4, thereby forming the tape roll R2 with print. At this time, the cutter mechanism 30 disposed on the transport direction downstream side (that is, the frontward side) cuts the adhesive tape 150" with print. With this arrangement, the adhesive tape 150" with print wound around the tape roll R2 with print can be cut based on a timing desired by the user and the tape roll R2 with print can be removed from the third storage part 4 after cutting.

Note that, at this time, although not explained by illustration, a non-adhesive tape (one without the above described adhesive layer 152 and separation material layer 151) may be wound around the print-receiving tape roll R1. In this case as well, the print-receiving tape roll R1 around which is wound the non-adhesive tape is received in the first storage part 3 from above by the mounting of the tape cartridge TK and stored with the axis O1 of the winding of the non-adhesive tape in the left-right direction. Then, the print-receiving tape roll R1, stored in the first storage part 3 (with the tape cartridge TK mounted), rotates in a predetermined rotating direction (the direction A in FIG. 2) inside the first storage part 3, thereby feeding out the non-adhesive tape.

Further, at this time, a shoot 15 (refer to FIG. 2) for switching the feeding path of the above described non-adhesive tape (or the above described print-receiving tape 150) between a side toward the tape roll R2 with print and a side toward the discharging exit (not shown) may be disposed. That is, the non-adhesive tape after print (or the tape 150" with print) may be discharged as is from the discharging exit (not shown) disposed on the second opening/closing cover 8*b* side, for example, of the housing 2 to the outside of the housing 2 without being wound inside the third storage part 4 as described later by switching the tape path by a switch operation of the shoot 15 using a switch lever (not shown).

Tape-Width Direction and Tape Up-Down Direction Guide Mechanism

One characteristic of this embodiment lies in the guide member disposed on the above described tape cartridge TK in order to achieve smooth feeding of the print-receiving tape 150. In the following, details on the functions will be described in order.

First Guide Member

As described above, in this embodiment, in a configuration that integrates the print-receiving tape roll R1 and the separation material roll R3 with the connecting arm 16, a concave part 26 that opens upward is formed near the above described peeling part 17 along the tape feeding path and between the above described roll coupling beam parts 24, 24 on the connecting arm 16, as shown in FIG. 5 and FIG. 8, to achieve smooth tape feeding such as described above.

A first guide member 27 is detachably mounted to the above described concave part 26. The first guide member 27 comprises guide protrusions 27*a*, 27*b* that protrude upward on both left and right sides of the rearward side, and guide protrusions 27*c*, 27*d* that protrude upward on both left and right sides of the frontward side. With these guide protrusions 27*a-d*, the first guide member 27, mounted to the concave part 26, causes the tape 150' with print (refer to FIG. 8) corresponding to the print-receiving tape 150 fed out from the print-receiving tape roll R1 to pass through in a tape posture where the tape cross-section is in the left-right direction (horizontal direction), and substantially contacts both tape-width direction ends during the passing, thereby guiding the tape-width direction (refer to FIG. 8). With this arrangement, it is possible to reliably achieve smooth tape feeding.

As shown in FIG. 5 and FIG. 8, the first guide member 27 comprises a left and right pair of substrate parts 27*e*, 27*e* fixed inside the above described roll coupling beam parts 24, 24. Convex parts 27*f*, 27*f* that protrude downward from the substrate parts 27*e*, 27*e* and fit together with the above described concave part 26 are disposed on the front end and rear end between the substrate parts 27*e*, 27*e*. At this time, the above described guide protrusions 27*c*, 27*d* protrude upward on the front end between the substrate parts 27*e*, 27*e*. Further, the above described guide protrusions 27*a*, 27*b* protrude upward on the rear end between the substrate parts 27*e*, 27*e*. The guide protrusions 27*a*, 27*b*, and the guide protrusions 27*c*, 27*d* are disposed away from each other at a separation distance substantially equal to the tape-width direction dimension (the desired width-direction dimension) of the tape 150' with print that is fed, and respectively substantially contact both tape-width direction ends of the tape 150' with print.

That is, the convex parts 27*f*, 27*f* are inserted into the concave part 26 from above to mount one of the first guide members 27 corresponding to the type (tape-width direction dimension) of the print-receiving tape 150 to the concave part 26 between the roll coupling beam parts 24, 24 of the connecting arm 16. With this arrangement, the tape 150' with print that is fed passes between the guide protrusions 27*a*, 27*b* and between the guide protrusions 27*c*, 27*d* of the first guide member 27 held in the concave part 26, in a tape posture in which the tape-width direction is in the left-right direction. At this time, both tape-width direction ends of the tape 150' with print substantially contact the inside of the guide protrusions 27*a*, 27*b* and the inside of the guide protrusions 27*c*, 27*d*, and are thus guided in the tape-width direction, respectively. With this arrangement, it is possible make the tape 150' with print smoothly pass through the first guide member 27.

Second Guide Member

Further, in this embodiment, a second guide member 28 that is tongue shaped is disposed in addition to the above described first guide member 27. The second guide member 28 substantially contacts the upper side section of the tape 150' with print that passes through while the tape-width direction is guided by the first guide member 27 as described above, thereby guiding the tape 150' with print in the up-down direction.

The second guide member 28 is integrally configured with the above described first connecting part 22. Then, the second guide member 28 is disposed so as to protrude from the rearward side to the frontward side of the left and right pair of roll coupling beams 24, 24 (in other words, from the adhesive tape roll R1 side to the separation material tape roll R3 side) inside the concave part 26.

Positioning the Head Holding Body

Another characteristic of this embodiment lies in the fact that the head holding body 10 is disposed movably in the left-right direction (in other words, the above described tape-width direction), and the positioning of the head holding body 10 in the above described left-right direction is performed on the tape cartridge TK side. In the following, the details on the functions will be described in order.

Occurrence of Print Deviation and the Like

In the case of a configuration in which the head holding body 10 is disposed on the first opening/closing cover 8*a* as in the tape printer 1 in this embodiment, the relative positions between the reference position of the above described print-receiving tape 150 fed out on the apparatus housing 2*a* side in the tape-width direction (width-direction center, for example) and the reference position for print (center position of the print range, for example) by the above described head holding body 10 may become misaligned in the tape-width direction from the positional relationship originally set by the play or the like of each apparatus component for the opening/closing operation of the first opening/closing cover 8*a*. In such a case, a decrease in print quality, such as deviation of the print formed on the print-receiving tape 150 to one side of the tape-width direction, may occur.

Contacted Part and Positioning Contacting Part

Hence, in this embodiment, the head holding body 10 (refer to FIG. 3) in the interior of the first opening/closing cover 8*a* is supported movably in the left-right direction with respect to the first opening/closing cover 8*a* by a suitable support structure (not shown). Further, a left and right pair of contacted parts 10*a*L, 10*a*R (hereinafter suitably generally referred to as "contacted parts 10*a*") with a strip shape that protrudes downward is disposed on both left and right sides of the head holding body 10.

Figure 9:
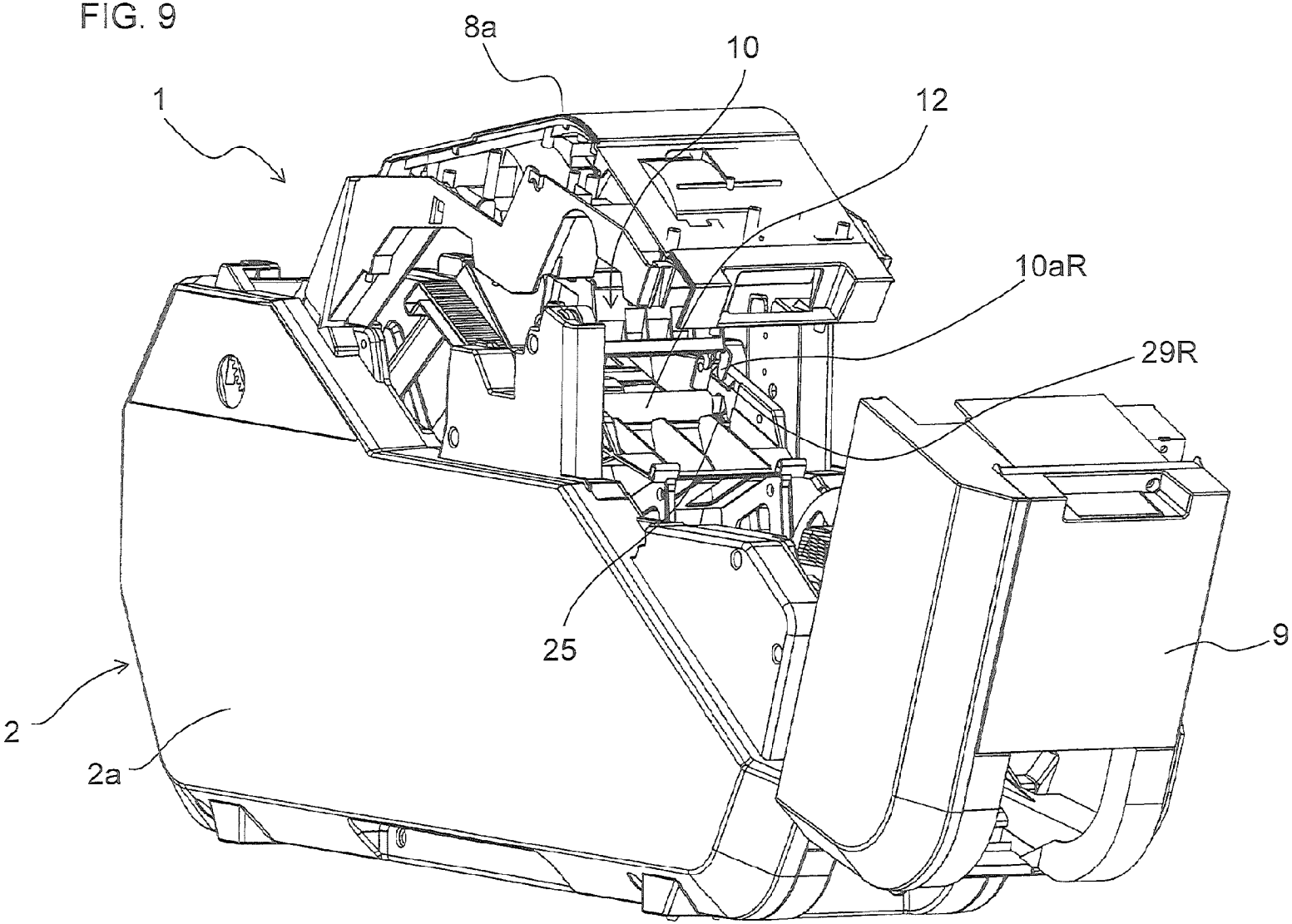
FIG. 9 is a perspective view showing the state immediately before the first opening/closing cover is closed.

On the other hand, left and right positioning contacting parts 29L, 29R mutually extend downward in a reverse truncated chevron shape near the respective roller storage parts 25, 25 of the left and right pair of roll coupling beams 24, 24 of the connecting arm 16, correspondingly to the above. At this time, the positioning contacting parts 29L, 29R (hereinafter, suitably generally referred to as "positioning contacting parts 29") comprise an inclined surface 29*a* that extends from the upper end edge of the roll coupling beam 24 toward the downward inner side in an inclined state, and a vertical surface 29*b* disposed so as to continue to the respective lower end sides of these positioning contacting parts 29L, 29R, below the above described inclined surface 29*a*. Then, with the first opening/closing cover 8*a* closed, the right-side positioning contacting part 29R contacts the right-side contacted part 10*a*R of the head holding body 10, and the left-side positioning contacting part 29L contacts the left-side contacted part 10*a*L of the head holding body 10, as shown in FIG. 9. With this arrangement, the positioning contacting parts 29 can position the head holding body 10 in the tape-width direction.

Further, at this time, a separation distance L between the above described vertical surface 29*b* of the left-side positioning contacting part 29L in the tape-width direction (left-right direction) and the above described vertical surface 29*b* of the right-side positioning contacting part 29R is substantially equal to a space W (refer to FIG. 3) between the left-side contacted part 10*a*L (refer to FIG. 5) and the right-side contacted part 10*a*R in the tape-width direction (left-right direction).

Control System

Figure 10:
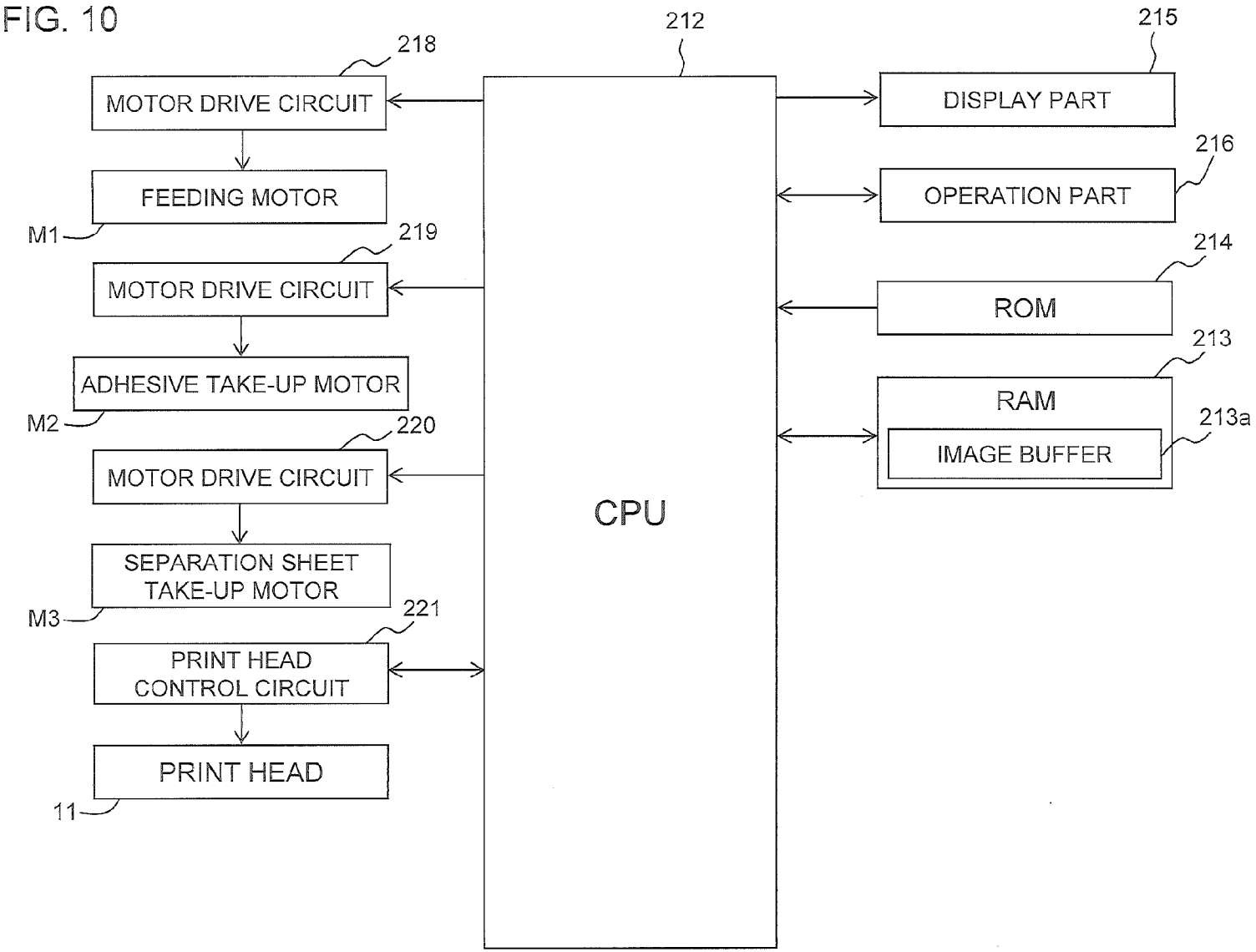
FIG. 10 is a function block diagram showing the configuration of the control system of the tape printer.

Next, the control system of the tape printer 1 will be described using FIG. 10. In FIG. 10, the tape printer 1 comprises a CPU 212 that constitutes a computing part that performs predetermined computations. The CPU 212 is connected to a RAM 213 and a ROM 214. The CPU 212 performs signal processing in accordance with a program stored in advance in the ROM 214 while utilizing a temporary storage function of the RAM 213, and controls the entire tape printer 1 accordingly.

Further, the CPU 212 is connected to a motor driving circuit 218 that controls the driving of the above described feeding motor M1 that drives the above described feeding roller 12, a motor driving circuit 219 that controls the driving of the above described adhesive take-up motor M2 that drives the above described tape roll R2 with print, a motor driving circuit 220 that controls the driving of the above described separation sheet take-up motor M3 that drives the above described separation material roll R3, a print head control circuit 221 that controls the conduction of the heating elements of the above described print head 11, a display part 215 that performs suitable displays, and an operation part 216 that permits suitable operation input by the user.

A control program for executing predetermined control processing is stored in the ROM 214. The RAM 213 comprises an image buffer 213*a* that expands print data of an image data format received from a PC (not shown), for example, into dot pattern data and stores the data for printing in a predetermined print area of the above described print-receiving layer 154. The CPU 212 performs printing corresponding to the print data by the print head 11 via the print head control circuit 221 in accordance with the print data stored in the image buffer 213*a* while the print-receiving tape 150 is fed out by the feeding roller 12, according to a suitable control program stored in the ROM 214.

Advantages of this Embodiment

As described above, in this embodiment, the first guide member 27 and the second guide member 28 are disposed on the tape cartridge TK. With this arrangement, as described above, it is possible to achieve smooth tape feeding by the guiding in the tape-width direction by the first guide member 27, and the guiding in the direction orthogonal to the tape-width direction by the second guide member 28. Particularly, the second guide member 28 can reliably suppress the occurrence of protrusion of the tape-width direction end above the first guide member 27 and the like, which may occur when only the guiding in the tape-width direction is performed using just the first guide member 27, thereby reliably achieving smooth tape feeding.

On the other hand, various print-receiving tapes 150 with mutually different width-direction dimensions may be used according to user preference and application. When the print-receiving tape roll R1, the separation material roll R3, the connecting arm 16, the first guide member 27, and the second guide member 28 are separately prepared per width-direction dimension in accordance with each of the plurality of types of the print-receiving tapes 150 and a separate tape cartridge TK is constructed per width-direction dimension, the number of products to be manufactured and the manufacturing process become cumbersome, causing a remarkable increase in the manufacturing cost.

Hence, in this embodiment, the connecting arm 16 that includes the concave part 26 and the second guide member 28 is common to the above described plurality of types of the print-receiving tape 150 with mutually different width-direction dimensions. Then, the configuration is designed so that a separate print-receiving tape roll R1, separation material tape roll R3, and first guide member 27 are prepared and assembled per tape-width direction dimension with respect to the common connecting arm 16 and concave part 26. Further, at this time, according to this embodiment, the first guide members 27 corresponding to the respective tape-width direction dimensions are individually prepared and made available for the plurality of mutually different types of the print-receiving tape 150. Then, the first guide member 27 corresponding to the print-receiving tape 150 is suitably selected and mounted to the concave part 26 disposed on the connecting arm 16, thereby guiding both width-direction ends of the tape 150' with print. With this arrangement, it is possible make the tape 150' with print smoothly pass through the first guide member 27.

As a result of the above, it is possible to make the connecting arm 16 (including the concave part 26 and the second guide member 28) common to the plurality of types of print-receiving tape 150 in a configuration that makes it possible to use a plurality of types of the print-receiving tape 150 in accordance with user needs and achieves smooth feeding thereof. With this arrangement, it is possible to reduce the manufacturing cost compared to a case where the print-receiving tape roll R1, the separation material tape roll R3, the connecting arm 16, the first guide member 27, as well as the second guide member 28 are each separately prepared per width-direction dimension.

Further, in particular, in this embodiment, the second guide member 28 is disposed so as to protrude from the rearward side to the frontward side inside the concave part 26. With this arrangement, it is possible to reliably guide both tape-width direction ends of the print-receiving tape 150 by mounting the first guide member 27 corresponding to the type of the print-receiving tape 150 from above to the concave part 26 between the left and right roll coupling beams 24, 24, and reliably guide the upper side surface of the print-receiving tape 150 using the second guide member 28 (refer to FIG. 8).

Further, in particular, in this embodiment, the second guide member 28 is integrally configured with the first connecting part 22 of the connecting arm 16. With this arrangement, it is possible to reliably and commonly dispose one second guide member 28 for a plurality of types of the print-receiving tape 150 with mutually different width-direction dimensions.

Further, in this embodiment, the head holding body 10 is disposed movably in the above described tape-width direction with respect to the first opening/closing cover 8*a*, and the positioning contacting parts 29 that position the above described head holding body 10 that is movable are disposed on the tape cartridge TK side. The contacted parts 10*a* that correspond thereto are then disposed on the head holding body 10. Then, the positioning contacting parts 29 are separated from the above described contacted parts 10*a* of the head holding body 10 when the first opening/closing cover 8*a* is open, and contact the contacted parts 10*a* when the first opening closing cover 8*a* is closed. With this arrangement, the head holding body 10 moveable in the above described tape-width direction is positioned in the tape-width direction. As a result, it is possible to suppress the occurrence of the aforementioned deviation of the print formed on the tape 150', 150" with print and the like and improve print quality, without performing complex print control or other such processes.

Further, in particular, in this embodiment, it is possible to both position the head holding body 10 from the left side and position the head holding body 10 from the right side by the two positioning contacting parts 29, 29 respectively disposed on both sides of the tape-width direction. With this arrangement, it is possible to reliably suppress the occurrence of deviation of the above described print and reliably improve the print quality.

Further, in particular, in this embodiment, the two positioning contacting parts 29, 29 are disposed near the roller storage part 25 that stores the feeding roller 12. The print head 11 forms print with the print-receiving tape 150 sandwiched between the print head 11 and the feeding roller 12, and thus the above described two positioning contacting parts 29, 29 perform the aforementioned positioning near the position where print is formed. As a result, it is possible to further reliably improve the print quality.

While the above has described an illustrative scenario in which the present disclosure is applied to the tape printer 1 that performs printing on the print-receiving tape 150, the present disclosure is not limited thereto, allowing application to a tape printer that performs processing other than printing on a tape.

Note that, in the above, the arrows shown in the FIG. 10 denote an example of signal flow, but the signal flow direction is not limited thereto.

Further, other than that already stated above, techniques based on the above described embodiments and each of the modifications may be suitably utilized in combination as well.

What is claimed is:

1. A medium cartridge that comprises a first record medium roll that winds a record medium in a manner that enables feed-out, and is configured to be mounted to a printer wherein a print mechanism configured to perform printing on said record medium is provided movably along a medium-width direction of said record medium with respect to an opening/closing cover capable of opening and closing at least an area above a part of an apparatus housing, the medium cartridge comprising:

a positioning contacting part configured to separate from a contacted part provided on said print mechanism with said opening/closing cover open, and to contact said contacted part of said print mechanism and position said print mechanism in said medium-width direction with said opening/closing cover closed.

2. The medium cartridge according to claim 1, further comprising:

a second record medium roll configured to take up and wind at least a part of said record medium fed out from said first record medium roll; and a connecting arm that connects said first record medium roll and said second record medium roll, wherein:

two of the positioning contacting parts are provided respectively on one side and another side of said connecting arm, in said medium-width direction;

the positioning contacting part on one side in said medium-width direction contacts said contacted part of said print mechanism on the one side in said medium-width direction; and the positioning contacting part on the other side in said medium-width direction contacts said contacted part of said print mechanism on the other side in said medium-width direction.

3. The medium cartridge according to claim 2, wherein:

said connecting arm comprises a roller storage part that stores a feeding roller configured to sandwich said record medium between itself and a print head provided on said print mechanism and feed the record medium; and said positioning contacting parts on the one side and the other side in said medium-width direction are respectively provided near said roller storage part.

4. The medium cartridge according to claim 2, wherein:

said positioning contacting part comprises an inclined surface that inclines and extends from one side toward another side of a beam provided on said connecting arm towards a center of said record medium in the medium-width direction.

5. The medium cartridge according to claim 4, wherein:

said positioning contacting part further comprises a vertical surface that extends in a direction orthogonal to said medium-width direction, from said one side toward said other side of said beam, successively provided on said other side of said inclined surface.

6. The medium cartridge according to claim 5, wherein:

a separation distance in said medium-width direction between said vertical surface of said positioning contacting part on the one side in said medium-width direction and said vertical surface of said positioning contacting part on the other side in said medium-width direction is substantially equal to a space in said medium-width direction between said contacted part on the one side in said medium-width direction and said contacted part on the other side in said medium-width direction.

7. A medium printer with a cartridge comprising a medium cartridge and a medium printer to which said medium cartridge is mounted in a predetermined position, said medium cartridge comprising:

a first record medium roll that winds a record medium in a manner that enables feed-out;

said medium printer comprising:

an apparatus housing;

an opening/closing cover capable of opening and closing at least an area above a part of said apparatus housing; and a print mechanism configured to perform printing on said record medium fed out from said first record medium roll of said medium cartridge mounted in said predetermined position;

said print mechanism being provided movably along a medium-width direction of said record medium with respect to said opening/closing cover; and said medium cartridge comprising a positioning contacting part configured to separate from a contacted part provided on said print mechanism with said opening/closing cover open, and to contact said contacted part of said print mechanism and position said print mechanism in said medium-width direction with said opening/closing cover closed.

8. A medium cartridge comprising:

a first rotating body that winds a medium;

a second rotating body configured to take up at least a part of said medium fed out by a rotation of said first rotating body;

a connecting arm that connects said first rotating body and said second rotating body; and two positioning contacting parts provided so as to be aligned in a width direction of said medium on said connecting arm, wherein each of said two positioning contacting parts comprises an inclined surface that inclines and extends from one side toward another side of said connecting arm, the inclined surface inclining and extending towards a center of said medium in the width direction of said medium.

* * * * *